US007362081B1

(12) United States Patent
Huang

(10) Patent No.: US 7,362,081 B1
(45) Date of Patent: Apr. 22, 2008

(54) LOW-DROPOUT REGULATOR

(75) Inventor: Shengming Huang, Gourock (GB)

(73) Assignee: National Semiconductor Corporation, Santa Clara, CA (US)

( * ) Notice: Subject to any disclaimer, the term of this patent is extended or adjusted under 35 U.S.C. 154(b) by 460 days.

(21) Appl. No.: 11/049,455

(22) Filed: Feb. 2, 2005

(51) Int. Cl.
*G05F 1/40* (2006.01)
*G05F 3/16* (2006.01)

(52) U.S. Cl. ..... 323/282; 323/313

(58) Field of Classification Search ..... 323/268, 323/271, 282, 285, 286, 312–317; 327/538, 327/539, 543
See application file for complete search history.

(56) References Cited

U.S. PATENT DOCUMENTS 6,144,250 A * 11/2000 Owen et al. ..... 327/539
6,304,131 B1 * 10/2001 Huggins et al. ..... 327/538
6,518,737 B1 * 2/2003 Stanescu et al. ..... 323/280
6,759,836 B1 * 7/2004 Black, Jr. ..... 323/288
6,822,514 B1 * 11/2004 Aude ..... 330/260
7,030,598 B1 * 4/2006 Dow ..... 323/313

* cited by examiner

*Primary Examiner*—Matthew V. Nguyen

(57) ABSTRACT

A low-dropout regulator is provided that includes a filter and a bandgap reference generator. The filter includes a resistive device and a capacitor. The bandgap reference generator is coupled to the filter and includes a resistive device controller. The resistive device controller is operable to control the resistive device in the filter. The bandgap reference circuit is operable to generate an unfiltered voltage reference, and the filter is operable to generate a filtered voltage reference based on the unfiltered voltage reference.

20 Claims, 2 Drawing Sheets

LOW-DROPOUT REGULATOR

TECHNICAL FIELD OF THE INVENTION

The present invention relates generally to voltage reference generators and, more particularly, to an improved low-dropout regulator.

BACKGROUND OF THE INVENTION

Many radiofrequency/analog applications make use of low-dropout regulators. For these and other applications, the regulators typically need low device noise and high power supply rejection ratios to operate properly. The main sources of noise contributing to the regulator output noise are a voltage reference, an output feedback resistor divider, and an error amplifier.

In order to improve the noise performance of the voltage reference, conventional regulators are designed to use an RC filter with a high value of either resistance or capacitance. However, because large capacitors consume a large amount of chip area, external noise bypass capacitors are normally used to provide additional capacitance. As an alternative, a bypass resistor with a large resistance may be used with a lower-capacitance bypass capacitor in order to provide low noise with an on-chip capacitor and resistor. However, as with a high-capacitance capacitor, a high-resistance resistor also consumes a large amount of chip area.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; "each" means every one of at least a subset of the identified items; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future, uses of such defined words and phrases.

BRIEF DESCRIPTION OF THE DRAWINGS

For a more complete understanding of the present invention and its advantages, reference is now made to the following description taken in conjunction with the accompanying drawings, wherein like reference numerals represent like parts, in which.

DETAILED DESCRIPTION OF THE INVENTION

Figure 1:
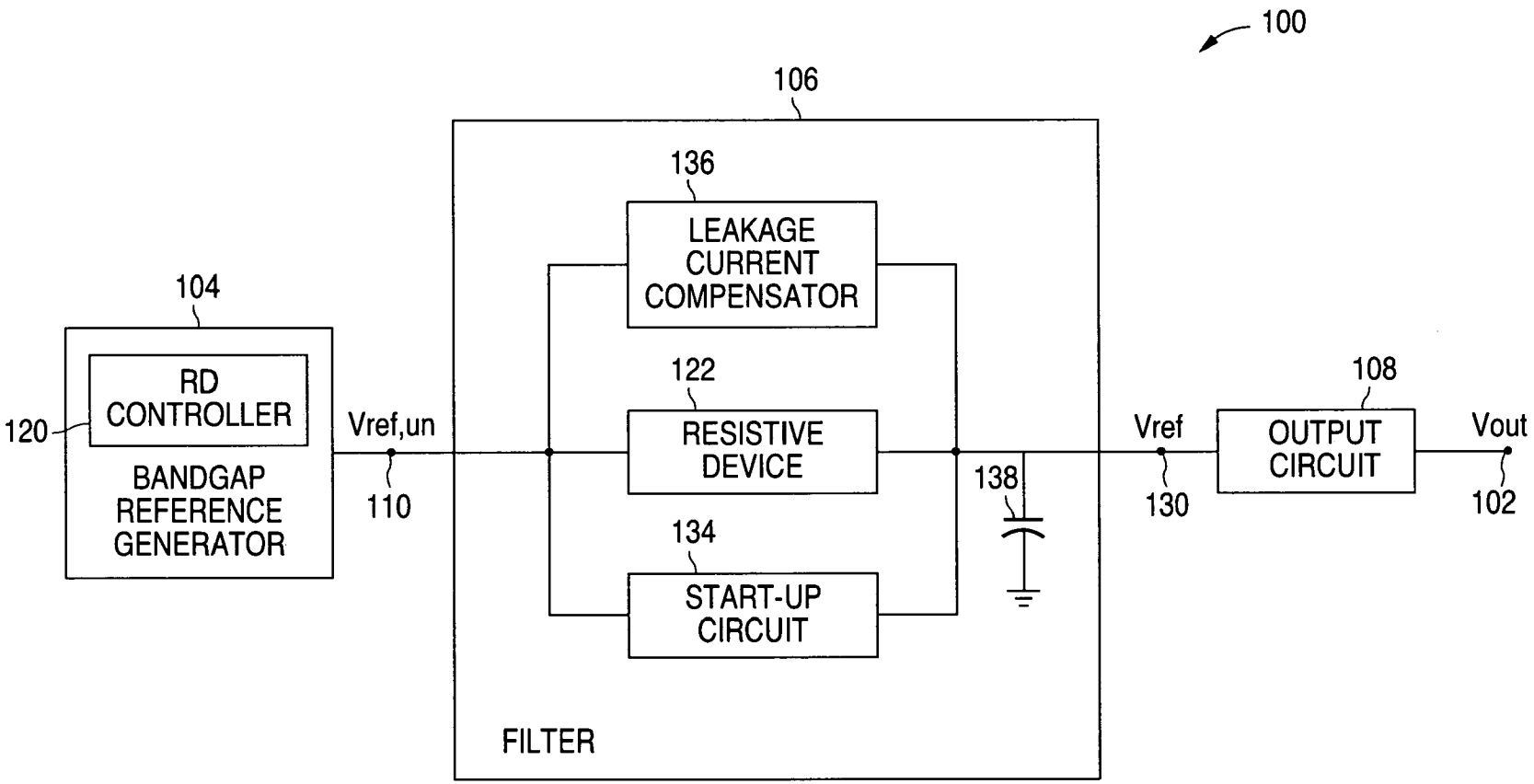
FIG. 1 is a block diagram illustrating a low-dropout regulator in accordance with one embodiment of the present invention.
Figure 2:
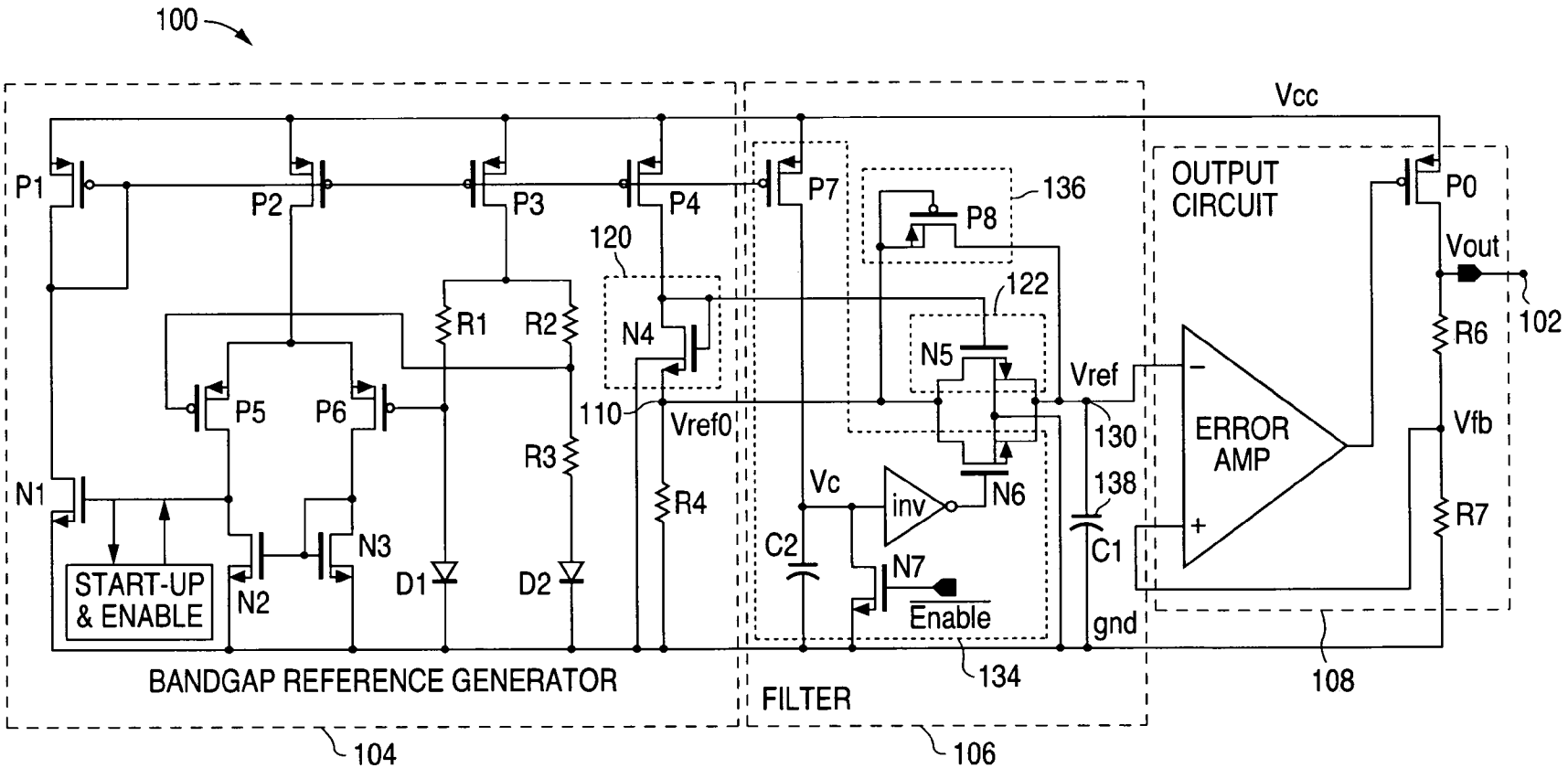
FIG. 2 is a circuit diagram illustrating the low-dropout regulator of FIG. 1 in accordance with one embodiment of the present invention.

FIGS. 1 through 2, discussed below, and the various embodiments used to describe the principles of the present invention in this patent document are by way of illustration only and should not be construed in any way to limit the scope of the invention. Those skilled in the art will understand that the principles of the present invention may be implemented in any type of suitably arranged regulator.

FIG. 1 is a block diagram illustrating a low-dropout (LDO) regulator 100 in accordance with one embodiment of the present invention. The LDO regulator 100 may be implemented in an integrated circuit and is operable to generate an output voltage (Vout) 102 that may be used by other suitable electronic components. The LDO regulator 100 comprises a bandgap reference generator 104, a filter 106 and an output circuit 108.

The bandgap reference generator 104 is operable to generate an unfiltered voltage reference (Vref,un) 110 for the LDO regulator 100. As described in more detail below, the bandgap reference generator 104 comprises a resistive device (RD) controller 120 for controlling a resistive device 122 in the filter 106.

The filter 106 is coupled to the bandgap reference generator 104 and is operable to receive the unfiltered voltage reference 110 from the bandgap reference generator 104 and to generate a filtered voltage reference (Vref) 130 based on the unfiltered voltage reference 110, without using an external bypass capacitor. Thus, the filter 106 is not coupled to any external bypass capacitors. As used herein, "external bypass capacitor" means a capacitor external to an integrated circuit comprising the LDO regulator 100. For one embodiment, the filter 106 comprises a start-up circuit 134, a leakage current compensator 136, and a capacitor 138, in addition to the resistive device 122.

The resistive device 122 is operable to provide resistance and the capacitor 138 is operable to provide capacitance in order to filter the unfiltered voltage reference 110. The start-up circuit 134 is coupled to the resistive device 122 and is operable to allow the filter 106 to have a fast start-up for generating the filtered voltage reference 130. In order to do this, during start-up, the start-up circuit 134 is operable to be switched on. After start-up, the start-up circuit 134 is operable to be switched off. The leakage current compensator 136 is also coupled to the resistive device 122. The leakage current compensator 136 is operable to compensate for leakage current in the filter 106.

The output circuit 108 is coupled to the filter 106. The output circuit 108 is operable to receive the filtered voltage reference 130 from the filter 106 and to generate the output voltage 102 for the LDO regulator 100 based on the filtered voltage reference 130. The output circuit 108 is operable to provide the output voltage 102 for use by any other suitable electronic component.

FIG. 2 is a circuit diagram illustrating the LDO regulator 100 in accordance with one embodiment of the present invention. For this embodiment, the bandgap reference generator 104 comprises six P-type metal-oxide semiconductor field-effect transistors (MOSFETs), four NMOSFETs, four resistors and two diodes. The filter 106 comprises two PMOSFETs, three NMOSFETs, an inverter and two capacitors. The output circuit 108 comprises an error amplifier, a PMOSFET and two feedback resistors. It will be understood that the components 104, 106 and 108 may comprise other or additional suitable components without departing from the scope of the present invention.

The resistive device controller 120 comprises one of the NMOSFETs, N4, in the bandgap reference generator 104. The bandgap reference generator 104 is operable to generate the unfiltered voltage reference 110 at the source of the NMOSFET N4. The gate of the NMOSFET N4 is coupled to its drain.

The resistive device 122 comprises one of the NMOSFETs, N5, in the filter 106. The gate of the NMOSFET N5 is coupled to the gate and the drain of the NMOSFET N4. Thus, the resistive device controller 120 is operable to control the resistive device 122 by controlling the current flowing through the NMOSFET N5.

For one embodiment, the channel width to channel length ratio (W/L ratio) of the NMOSFET N5 is designed to be much smaller than the W/L ratio of the NMOSFET N4. The NMOSFET N4 operates in the saturation state and the NMOSFET N5 operates in the linear region so that the NMOSFET N5 may provide resistance for the filter 106. For a particular embodiment, the W/L ratio of the NMOSFET N4 is 200 μp/1μ and the W/L ratio of the NMOSFET N5 is 1μ/200μ. However, it will be understood that the W/L ratios may be any suitable values without departing from the scope of the present invention.

The equivalent resistance of the NMOSFET N5 that forms the resistive device 122 is variable. At the beginning of start-up, the filtered voltage reference 130 is less than the unfiltered voltage reference 110 and the gate-to-source voltage of the NMOSFET N5 is high. This results in the resistance of the NMOSFET N5 being small, which allows a high current to flow through it. Because of this, a faster start-up may be accomplished as compared to a fixed, large bypass resistor. However, if the size of the NMOSFET N5 is relatively small, the current available to charge the capacitor C1 138 is limited by the NMOSFET N5 as the filtered voltage reference 130 increases. In this situation, the start-up circuit 134 may be used to provide a faster start-up.

The start-up circuit 134 comprises one of the PMOSFETs, two of the NMOSFETs, the inverter and one of the capacitors of the filter 106. According to one embodiment, the capacitance of the capacitor C2 is less than about 5 pF; however, it will be understood that the capacitor C2 may comprise any suitable capacitance without departing from the scope of the present invention.

Once the bandgap reference generator 104 is enabled, the NMOSFET N7 is turned off from on-state before start-up and the PMOSFET P7 begins to charge the capacitor C2. Thus, the signal provided to the inverter is initially close to ground, and the signal from the inverter turns on the NMOSFET N6. Then, as the PMOSFET P7 charges up the capacitor C2, the signal provided to the inverter increases until the signal from the inverter turns off the NMOSFET N6. Thus, the start-up circuit 134 enables the filter to get a fast start-up of the filtered voltage reference 130 through the use of the NMOSFET N6.

For one embodiment, the size of the PMOSFET P7 is designed to be smaller than that of the PMOSFET P4 in the bandgap reference generator 104, resulting in a current flowing through the PMOSFET P7 that is only a fraction, e.g. 1/10, of the current flowing through the PMOSFET P4. This ensures that the turn-on time for the NMOSFET N6 will be longer than the start-up time of the filtered voltage reference 130. If the current flowing through the PMOSFET P4 (which may be, for example, about 1 to 2 μA) is built up as soon as the PMOSFET P4 is enabled, then the following equation holds:

$$V\text{ref}=V\text{ref,un}[1-e^{\wedge}(-t/R4*C1)],$$

where R4 is the resistance provided by the resistor R4 in the bandgap reference generator 104 and C1 is the capacitance provided by the capacitor C1 138 in the filter 106. In addition, the start-up time, $t_s$, is defined as the time for the filtered voltage reference 130 to rise to 95% of the voltage provided by the unfiltered voltage reference 110. Thus, $$t_s=R4*C1*\ln 20.$$

The minimum time, $t_{on}$, for the inverter in the start-up circuit 134 to change states is given by:

$$t_{on}=C2*V_{tn}/I_{P7},$$

where C2 is the capacitance provided by the capacitor C2 in the start-up circuit 134, $V_{tn}$ is the threshold voltage of the NMOSFET N6, and $I_{P7}$ is the current flowing through the PMOSFET P7. Thus, the start-up of the filtered voltage reference 130 remains unaffected by a small-sized NMOSFET N5, as long as $t_{on}$ is greater than $t_s$.

The error amplifier of the output circuit 108 is operable to receive the filtered voltage reference 130 and a feedback signal from between the two feedback resistors and to generate a signal at the gate of the PMOSFET. For one embodiment, the feedback resistor ratio, R6/R7, is less than or equal to 2. However, it will be understood that the feedback resistor ratio may comprise any suitable value without departing from the scope of the present invention. The output circuit 108 is operable to generate the output voltage 102 at the drain of the PMOSFET.

Under DC conditions, the unfiltered voltage reference 110 is essentially the same as the filtered voltage reference 130 and the gate-to-source voltage of the NMOSFET N5 decreases, providing a relatively large equivalent resistance. In this way, a low noise may be achieved with the use of a relatively small on-chip capacitor C1 138 in the filter 106. For one embodiment, the capacitance of the capacitor C1 138 comprises about 10 pF; however, it will be understood that the capacitor C1 138 may comprise any suitable capacitance without departing from the scope of the present invention. Both NMOSFETs N4 and N5 use a relatively small area of the integrated circuit as compared to a large bypass resistor. In addition, there is essentially no DC current flowing through the PMOSFET P7 and the inverter.

Since the P-substrate of the NMOSFETs N5 and N6 are to be coupled to ground, two reverse-biased PN junctions are included from the filtered voltage reference 130 to ground. A unit width (PN junction area) of the NMOSFET N6 may be designed to reduce the PN junction leakage current at high temperatures. To compensate for this leakage current, the leakage current compensator 136 comprises a PMOSFET P8 that is coupled between the unfiltered voltage reference 110 and the filtered voltage reference 130. The PMOSFET P8 operates in an off state. However, a reverse-biased PN junction from the substrate (N-well) to the drain of the PMOSFET P8 supplies the leakage current to the filtered voltage reference 130 when the filtered voltage reference 130 is slightly lower than the unfiltered voltage reference 110 at higher temperatures. Therefore, the width (PN junction area) of the PMOSFET P8 is designed to be wider than the total width of the NMOSFETs N5 and N6.

In this way, without using an external bypass capacitor, low noise and a high power supply rejection ratio may be maintained in the low-dropout regulator 100. In addition, large on-chip capacitors and resistors are not used in the regulator 100. As a result, a low-dropout regulator 100 is provided that performs as well as a regulator using large on-chip capacitors or resistors and/or using external bypass capacitors without sacrificing the chip area or requiring the use of an external bypass capacitor.

Although the present invention has been described with several embodiments, various changes and modifications may be suggested to one skilled in the art. It is intended that the present invention encompass such changes and modifications as fall within the scope of the appended claims.

What is claimed is:

1. A low-dropout regulator, comprising:

a filter comprising a resistive device and a capacitor; and a bandgap reference generator coupled to the filter, the bandgap reference generator comprising a resistive device controller operable to control the resistive device, the bandgap reference circuit operable to generate an unfiltered voltage reference, the filter operable to generate a filtered voltage reference based on the unfiltered voltage reference.

2. The low-dropout regulator of claim 1, the filter coupled to no external bypass capacitor.

3. The low-dropout regulator of claim 1, the resistive device comprising a first NMOSFET, and the resistive device controller comprising a second NMOSFET having a gate coupled to a gate of the first NMOSFET.

4. The low-dropout regulator of claim 1, the filter further comprising a start-up circuit coupled to the resistive device, the start-up circuit operable to be switched on during start-up and to be switched off after start-up.

5. The low-dropout regulator of claim 4, the start-up circuit comprising a PMOSFET, a first NMOSFET, a second NMOSFET, a second capacitor and an inverter, the first NMOSFET operable to ground an input to the inverter, the input to the inverter coupled to the second capacitor, the PMOSFET operable to charge the second capacitor to increase the input to the inverter, the inverter operable to turn on and to turn off the second NMOSFET.

6. The low-dropout regulator of claim 1, the filter further comprising a leakage current compensator coupled to the resistive device, the leakage current compensator operable to compensate for leakage current in the filter.

7. The low-dropout regulator of claim 6, the leakage current compensator comprising a PMOSFET coupled between the unfiltered voltage reference and the filtered voltage reference.

8. The low-dropout regulator of claim 1, further comprising an output circuit coupled to the filter, the output circuit operable to generate an output voltage for the regulator based on the filtered voltage reference.

9. The low-dropout regulator of claim 1, the capacitor comprising a capacitance of about 10 pF.

10. A low-dropout regulator, comprising:

a filter comprising a resistive device, a capacitor and a start-up circuit, the start-up circuit operable to be switched on during start-up and to be switched off after start-up, the filter coupled to no external bypass capacitor;

a bandgap reference generator coupled to the filter, the bandgap reference generator comprising a resistive device controller operable to control the resistive device, the bandgap reference circuit operable to generate an unfiltered voltage reference, the filter operable to generate a filtered voltage reference based on the unfiltered voltage reference; and an output circuit coupled to the filter, the output circuit operable to generate an output voltage for the regulator based on the filtered voltage reference.

11. The low-dropout regulator of claim 10, the resistive device comprising a first NMOSFET.

12. The low-dropout regulator of claim 11, the resistive device controller comprising a second NMOSFET having a gate coupled to a gate of the first NMOSFET.

13. The low-dropout regulator of claim 10, the start-up circuit comprising a PMOSFET, a first NMOSFET, a second NMOSFET, a second capacitor and an inverter, the first NMOSFET operable to ground an input to the inverter, the input to the inverter coupled to the second capacitor, the PMOSFET operable to charge the second capacitor to increase the input to the inverter, the inverter operable to turn on and to turn off the second NMOSFET.

14. The low-dropout regulator of claim 10, the filter further comprising a leakage current compensator coupled to the resistive device, the leakage current compensator operable to compensate for leakage current in the filter.

15. The low-dropout regulator of claim 14, the leakage current compensator comprising a PMOSFET coupled between the unfiltered voltage reference and the filtered voltage reference.

16. The low-dropout regulator of claim 10, the capacitor comprising a capacitance of about 10 pF.

17. A low-dropout regulator, comprising:

a filter comprising a resistive device, a first capacitor and a start-up circuit, the resistive device comprising a first NMOSFET, the start-up circuit comprising a PMOSFET, a second NMOSFET, a third NMOSFET, a second capacitor and an inverter, the second NMOSFET operable to ground an input to the inverter, the input to the inverter coupled to the second capacitor, the PMOSFET operable to charge the second capacitor to increase the input to the inverter, the inverter operable to turn on and to turn off the third NMOSFET, and the filter coupled to no external bypass capacitor;

a bandgap reference generator coupled to the filter, the bandgap reference generator comprising a resistive device controller operable to control the resistive device, the resistive device controller comprising a fourth NMOSFET having a gate coupled to a gate of the first NMOSFET, the bandgap reference circuit operable to generate an unfiltered voltage reference, the filter operable to generate a filtered voltage reference based on the unfiltered voltage reference; and an output circuit coupled to the filter, the output circuit operable to generate an output voltage for the regulator based on the filtered voltage reference.

18. The low-dropout regulator of claim 17, the filter further comprising a leakage current compensator coupled to the resistive device, the leakage current compensator operable to compensate for leakage current in the filter.

19. The low-dropout regulator of claim 18, the leakage current compensator comprising a second PMOSFET coupled between the unfiltered voltage reference and the filtered voltage reference.

20. The low-dropout regulator of claim 17, the first capacitor comprising a capacitance of about 10 pF, and the second capacitor comprising a capacitance of less than about 5 pF.

* * * * *